US011026474B2

(12) United States Patent
Suffolk et al.

(10) Patent No.: US 11,026,474 B2
(45) Date of Patent: Jun. 8, 2021

(54) BALLET POINTE SHOE

(71) Applicant: DREW LAYNE, LLC, Lantana, TX (US)

(72) Inventors: Mark Suffolk, Lantana, TX (US); Keri Suffolk, Lantana, TX (US)

(73) Assignee: DREW LAYNE, LLC, Lantana, TX (US)

( * ) Notice: Subject to any disclaimer, the term of this patent is extended or adjusted under 35 U.S.C. 154(b) by 455 days.

(21) Appl. No.: 16/000,833

(22) Filed: Jun. 5, 2018

(65) Prior Publication Data

US 2019/0365025 A1 Dec. 5, 2019

(51) Int. Cl.
*A43B 7/14* (2006.01)
*A43B 5/12* (2006.01)
*A43B 7/24* (2006.01)

(52) U.S. Cl.
CPC ..... *A43B 7/145* (2013.01); *A43B 5/12* (2013.01); *A43B 7/1465* (2013.01); *A43B 7/24* (2013.01)

(58) Field of Classification Search
CPC ..... A43B 5/12; A43B 7/145
See application file for complete search history.

(56) References Cited

U.S. PATENT DOCUMENTS 1,525,848 A * 2/1925 Bonaventure ..... A43B 5/12 36/8.3
1,937,218 A * 11/1933 Di Rienzo ..... A43B 5/12 36/8.3
2,118,835 A * 5/1938 Capezio ..... A43B 5/12 36/8.3
4,333,472 A 6/1982 Tager et al.
5,035,069 A * 7/1991 Minden ..... A43B 5/12 36/113
5,129,165 A 7/1992 Woodle
5,191,726 A * 3/1993 Vallee ..... A43B 5/12 36/113
5,469,641 A * 11/1995 Subotic ..... A43B 5/12 36/71
6,092,314 A 7/2000 Rothbart
6,238,359 B1 5/2001 Anderson
D499,958 S 12/2004 Crane
7,036,244 B1 5/2006 Finch
9,491,981 B2 * 11/2016 Suffolk ..... A43B 17/16
(Continued)

FOREIGN PATENT DOCUMENTS

WO WO2004107895 A1 12/2004
WO WO2007029964 A1 3/2007
(Continued)

OTHER PUBLICATIONS

FAIPP Pre-Interview Communication dated Nov. 10, 2015, U.S. Appl. No. 14/373,993, filed Jul. 23, 2014.
(Continued)

*Primary Examiner* — Jila M Mohandes

(57) ABSTRACT

A ballet pointe shoe is disclosed comprising a toebox, a platform at a front end of the toebox, a shank, an upper, a heel, and a single continuous sole. The single continuous sole comprises a front end closest to the toebox, a back end closest to the heel, and a waist defined as a narrowest part of the single continuous sole. The waist is positioned at more than 65 percent of the length of the single continuous sole from the front end of the single continuous sole. A ratio of (i) the waist to the back end of the single continuous sole to (ii) the waist to the front end of the single continuous sole is at least 42 percent.

21 Claims, 4 Drawing Sheets

(56) References Cited

U.S. PATENT DOCUMENTS

| | | | | |
|---|---|---|---|---|
| 2004/0093761 | A1* | 5/2004 | Nye | A43B 23/08 36/8.3 |
| 2005/0022421 | A1 | 2/2005 | Bruckner | |
| 2007/0000149 | A1* | 1/2007 | Juniman | A43B 5/12 36/8.3 |
| 2007/0199208 | A1* | 8/2007 | Wilkenfeld | A43B 5/12 36/8.3 |
| 2008/0209761 | A1 | 9/2008 | Thoraval | |
| 2009/0151200 | A1 | 6/2009 | Niedermeyer et al. | |
| 2010/0263231 | A1 | 10/2010 | Smirman | |
| 2011/0010963 | A1 | 1/2011 | Webb | |
| 2011/0265348 | A1 | 11/2011 | Schmutte | |
| 2012/0055045 | A1 | 3/2012 | Wang | |
| 2018/0055139 | A1* | 3/2018 | Whiteside | A43B 7/144 |

FOREIGN PATENT DOCUMENTS

| | | | |
|---|---|---|---|
| WO | WO2010132364 | A2 | 11/2010 |
| WO | WO2013101967 | A1 | 7/2013 |

OTHER PUBLICATIONS

Final Office Action dated May 27, 2016, U.S. Appl. No. 14/373,993, filed Jul. 23, 2014.

Advisory Action dated Jul. 13, 2016, U.S. Appl. No. 14/373,993, filed Jul. 23, 2014.

Office Action dated Aug. 22, 2016, U.S. Appl. No. 14/373,993, filed Jul. 23, 2014.

Notice of Allowance dated Oct. 3, 2016, U.S. Appl. No. 14/373,993, filed Jul. 23, 2014.

Foreign Communication from a Related Counterpart—International Search Report and Written Opinion, dated Apr. 26, 2013, Application No. PCT/US2012/071888, filed Dec. 28, 2012.

Foreign Communication from a Related Counterpart—International Preliminary Report on Patentability, dated Jul. 10, 2014, Application No. PCT/US20121071888, filed Dec. 28, 2012.

Suffolk, Mark, et al., "Toe Wedge for a Ballet Pointe Shoe," filed Dec. 29, 2011, U.S. Appl. No. 61/581,373.

* cited by examiner

BALLET POINTE SHOE

BACKGROUND

A ballet pointe shoe is a type of shoe worn by ballet dancers when performing pointe work (i.e. dancing "en pointe"). "En pointe" means "on the tip" and is part of a classical ballet technique in which dancers perform on the tips of their toes. Ballet pointe shoes developed from the desire for dancers to appear weightless and sylph-like.

SUMMARY

In one embodiment of the disclosure, a ballet pointe shoe is disclosed. The ballet pointe shoe comprises a toebox, a platform at a front end of the toebox, a shank, an upper, a heel, and a single continuous sole. The single continuous sole comprises a front end closest to the toebox, a back end closest to the heel, and a waist defined as a narrowest part of the single continuous sole. The waist is positioned at more than about 65 percent of the length of the single continuous sole from the front end of the single continuous sole. A ratio of (i) the waist to the back end of the single continuous sole to (ii) the waist to the front end of the single continuous sole is at least about 42 percent.

In another embodiment of the disclosure, a ballet pointe shoe is disclosed. The ballet pointe shoe comprises a toebox, a platform at a front end of the toebox, a shank, an upper, a heel, and a single continuous sole. The single continuous sole comprises a front end closest to the toebox, a back end closest to the heel, and a waist defined as a narrowest part of the single continuous sole. The waist is positioned at more than about 69 percent of the length of the ballet pointe shoe from the platform to the back end of the single continuous sole. A ratio of (i) the waist to the back end of the single continuous sole to (ii) the waist to the front end of the single continuous sole is at least about 42 percent.

In yet another embodiment of the disclosure, a ballet pointe shoe is disclosed. The ballet pointe shoe comprises a toebox, a platform at a front end of the toebox, a shank, an upper, a heel, and a single continuous sole. The single continuous heel comprises a front end closest to the toebox, a back end closest to the heel, and a waist defined as a narrowest part of the single continuous sole. The waist is positioned at more than at least about 64 percent of the length of the single continuous sole from a toe transition point to a heel transition point. A ratio of (i) a width of the waist to (ii) a width of a widest part of the single continuous sole closest to the back end is less than about 85 percent.

In a further embodiment of the disclosure, a ballet pointe shoe is disclosed. The ballet pointe shoe comprises a toebox, a shank, an upper, a heel, and a platform at a front end of the toebox. At least a portion of the platform comprises a concave surface.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
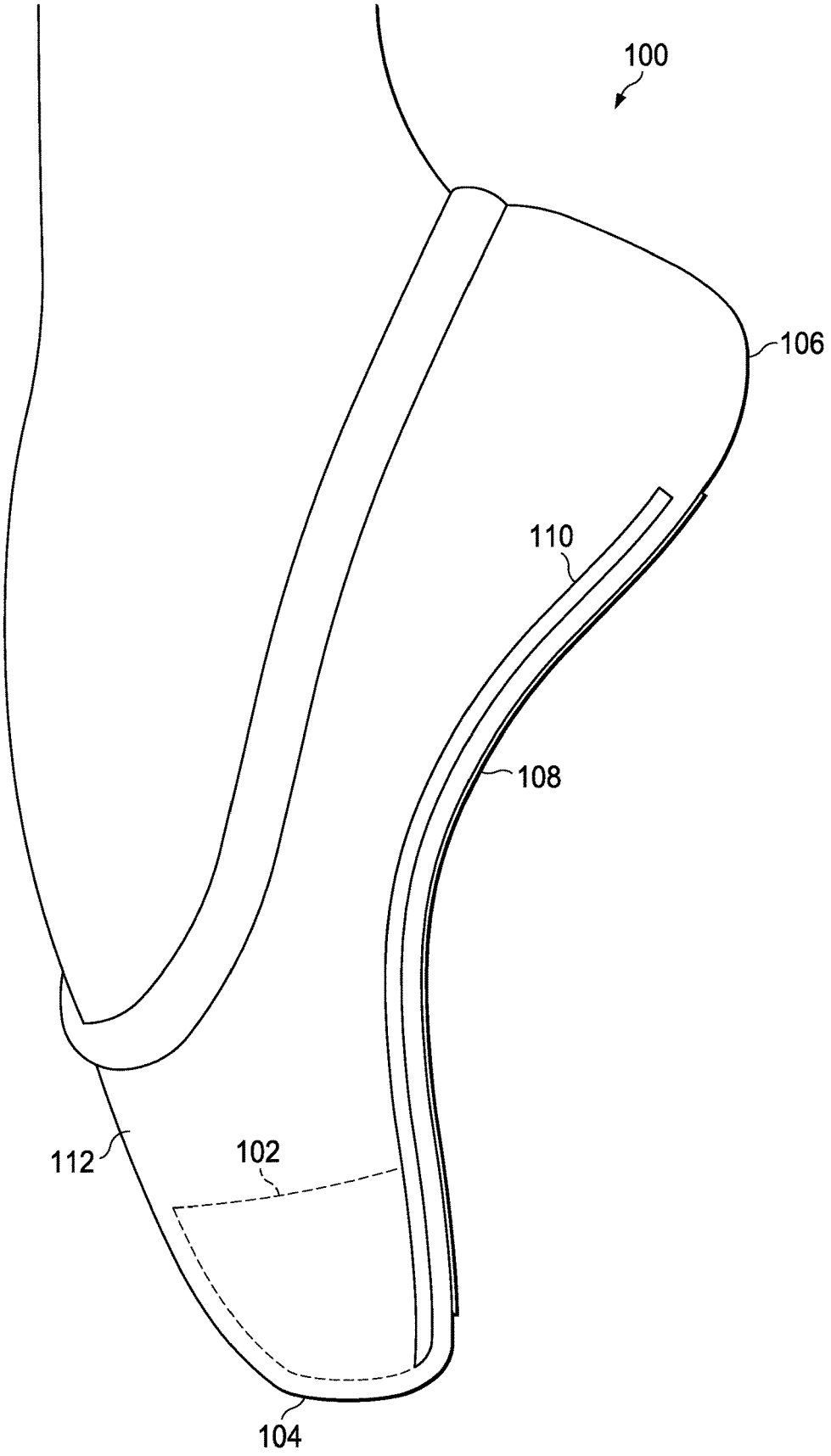
FIG. 1 illustrates a ballet pointe shoe according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Ballet pointe shoes comprise a sole on the bottom of ballet pointe shoe. The waist of the sole is defined as the narrowest part of the sole. The pending disclosure teaches a ballet pointe shoe that comprises a high-waisted, single continuous sole. In particular, the waist of the single continuous sole for the disclosed ballet pointe shoe has been moved closer to the heel. This positioning of the waist of the sole closer to the heel has several advantages. For example, the high-waisted sole elevates and lifts the dancer, allowing her to "break" the shoe in the correct place to fit her arch, thereby gaining more control of her foot movement. Additionally, since the high-waisted sole enables the dance to "break" the shoe in the correct place, the life of the ballet pointe shoe is extended.

Other ballet pointe shoes manufactured by the same manufacturer of the disclosed high-waisted ballet pointe shoe (hereinafter referred to as "classic ballet pointe shoe") have a sole that comprises a waist positioned lower (i.e., closer to the toe) than the sole of the disclosed high-waisted ballet pointe shoe. The pending disclosure qualitatively and quantitatively articulates the positioning of the waist in three different ways looking at three different ratios in comparison to traditional ballet pointe shoes, although the differences could be articulated in other ways without departing from the spirit or scope of the disclosure. In a first embodiment, the pending disclosure looks at the ratio of the waist of the sole from the front end of the sole to the total length of the sole. In the first embodiment, the ratio of the waist from the front end of the sole to the total length of the sole for the classic ballet pointe shoe may be about 56 percent whereas the ratio of the waist from the front end of the sole to the total length of the sole for the high-waisted ballet pointe shoe may range from about 67 percent to about 70 percent depending on shoe size.

In a second embodiment, the pending disclosure looks at the ratio of the waist from the platform to the length of the shoe from the platform to the back end of the sole. In the second embodiment, the ratio of the waist from the platform to the length of the shoe from the platform to the back end of the sole for the classic ballet pointe shoe may be about 60 percent whereas the ratio of the waist from the platform to the length of the shoe from the platform to the back end of the sole for the high-waisted ballet pointe shoe may range from about 70 percent to about 73 percent depending on shoe size.

In a third embodiment, the pending disclosure looks at the ratio of a toe transition point to the waist to the toe transition point to a heel transition point. In the third embodiment, the ratio of the toe transition point to the waist to the toe transition point to the heel transition point for the classic ballet pointe shoe may range from about 49 percent to about 54 percent depending on shoe size whereas the ratio of the toe transition point to the waist to the toe transition point to the heel transition point for the high-waisted ballet pointe shoe may range from about 71 percent to about 78 percent depending on shoe size.

Similar to the classic ballet pointe shoe discussed above, other ballet pointe shoes manufactured by different manufacturers have a sole that comprises a waist positioned lower (i.e., closer to the toe) than the sole of the disclosed high-waisted ballet pointe shoe. However, ballet pointe shoes from different manufacturers are not necessarily directly comparable to the ballet pointe shoes manufactured by the manufacturer of the high-waisted ballet pointe shoe because the ballet pointe shoes from the different manufacturers have alternative characteristics seeking presumably other benefits and therefore look different (e.g., come in different shapes, a back end portion of the sole closest to the heel may be shorter, soles may be shorter, a back end portion of the sole closest to the heel may be narrower, etc.). Thus, a direct comparison using the ratios discussed above becomes a bit more challenging and the need to distinguish some of the ballet pointe shoes from the different manufacturers in other ways arises.

For example, with respect to the first embodiment discussed above looking at the ratio of the waist of the sole from the front end of the sole to the total length of the sole, the ratio of the waist from the front end of the sole to the total length of the sole for the ballet pointe shoes manufactured by the different manufacturers may range from about 48 percent to about 64 percent depending on shoe size. In contrast, as discussed above, the ratio of the waist from the front end of the sole to the total length of the sole for the high-waisted ballet pointe shoe may range from about 67 about to about 70 percent depending on shoe size. One of the ballet pointe shoes manufactured by one of the different manufacturers has a significantly shorter back end portion of the sole closest to the heel than the high-waisted ballet pointe shoe, which changes the relevance of the ratio of the waist from the front end of the total length of sole to the total length of the sole. For example, for that ballet pointe shoe, a ratio of (i) the waist to the back end of the single continuous sole to (ii) the waist to the front end of the single continuous sole may be less than 42 percent. In contrast, for the high-waisted ballet pointe shoe, a ratio of (i) the waist to the back end of the single continuous sole to (ii) the waist to the front end of the single continuous sole may range from about 43 percent to 48 percent depending on shoe size.

Thus, at least the ballet pointe shoe manufactured by one of the different manufacturers having a ratio of (i) the waist to the back end of the single continuous sole to (ii) the waist to the front end of the single continuous sole not being at least 42 percent is excluded from coverage. Stated differently in terms of the high-waisted ballet pointe shoe disclosed herein, the high-waisted ballet pointe shoe may comprise a single continuous sole comprising a front end closest to the toebox, a back end closest to the heel, and a waist defined as a narrowest part of the single continuous sole, wherein the waist is positioned at more than about 65 percent of the length of the single continuous sole from the front end of the single continuous sole, and wherein a ratio of (i) the waist to the back end of the single continuous sole to (ii) the waist to the front end of the single continuous sole is at least about 42 percent. In some embodiments, the waist is positioned at between 67 percent and 73 percent the length of the single continuous sole from the front end of the single continuous sole and the ratio of (i) the waist to the back end of the single continuous sole to (ii) the waist to the front end of the single continuous sole is between 42 percent and 80 percent.

In another example, with respect to the second embodiment discussed above looking at the ratio of the waist from the platform to the length of the shoe from the platform to the back end of the sole, the ratio of the waist from the platform to the length of the shoe from the platform to the back end of the sole for the ballet pointe shoes manufactured by the different manufacturers may range from about 54 percent to about 68 percent depending on shoe size. In contrast, as discussed above, the ratio of the waist from the front end of the sole to the total length of the sole for the high-waisted ballet pointe shoe may range from about 70 percent to about 73 percent depending on shoe size. One of the ballet pointe shoes manufactured by one of the different manufacturers has a significantly shorter back end portion of the sole closest to the heel than the high-waisted ballet pointe shoe, which changes the relevance of the ratio of the waist from the platform to the length of the shoe from the platform to the back end of the sole. For example, as discussed above, for that ballet pointe shoe, a ratio of (i) the waist to the back end of the single continuous sole to (ii) the waist to the front end of the single continuous sole may be less than 42 percent whereas for the high-waisted ballet pointe shoe, a ratio of (i) the waist to the back end of the single continuous sole to (ii) the waist to the front end of the single continuous sole may range from about 43 percent to about 48 percent depending on shoe size.

Thus, at least the ballet pointe shoe manufactured by one of the different manufacturers having a ratio of (i) the waist to the back end of the single continuous sole to (ii) the waist to the front end of the single continuous sole not being at least 42 percent is excluded from coverage. Stated differently in terms of the high-waisted ballet pointe shoe disclosed herein, the high-waisted ballet pointe shoe may comprise a single continuous sole comprising a front end closest to the toebox, a back end closest to the heel, and a waist defined as a narrowest part of the single continuous sole, wherein the waist is positioned at more than about 69 percent of the length of the ballet pointe shoe from the platform to the back end of the single continuous sole, and wherein a ratio of (i) the waist to the back end of the single continuous sole to (ii) the waist to the front end of the single continuous sole is at least about 42 percent. In some embodiments, the waist is positioned at between 69 percent and 75 percent the length of the ballet pointe shoe from the platform to the back end of the single continuous sole and the ratio of (i) the waist to the back end of the single continuous sole to (ii) the waist to the front end of the single continuous sole is between 42 percent and 80 percent.

In another example, with respect to the third embodiment discussed above looking at the ratio of a toe transition point to the waist to the toe transition point to a heel transition point, the ratio of the toe transition point to the waist to the toe transition point to the heel transition point for the ballet pointe shoes manufactured by the different manufacturers may be range from about 43 percent to about 63 percent depending on shoe size. In contrast, as discussed above, the ratio of the toe transition point to the waist to the toe transition point to the heel transition point for the high-waisted ballet pointe shoe may range from about 71 percent to about 78 percent depending on shoe size. Some of the ballet pointe shoes manufactured by one or more of the different manufacturers have a significantly narrower, more uniform back end portion of the sole closest to the heel than the high-waisted ballet pointe shoe, which changes the relevant the ratio of the toe transition point to the waist to the toe transition point to a heel transition. For example, for those ballet pointe shoes, a ratio of (i) a width of the waist to (ii) a width of a widest part of a back end closest to the heel may be greater than 88 percent whereas for the high-waisted ballet pointe shoe, a ratio of (i) a width of the waist to (ii) a width of a widest part of the sole closest to the back end may range from about 68 percent to about 70 percent depending on shoe size.

Thus, at least the ballet pointe shoes manufactured by one or more of the different manufacturers having a ratio of (i) a width of the waist to (ii) a width of a widest part of the single continuous sole closest to the back end not being less than about 85 percent are excluded from coverage. Stated differently in terms of the high-waisted ballet pointe shoe disclosed herein, the high-waisted ballet pointe shoe comprises a single continuous sole comprising a front end closest to the toebox, a back end closest to the heel, and a waist defined as a narrowest part of the single continuous sole, wherein the waist is positioned at more than at least about 64 percent of the length of the single continuous sole from a toe transition point to a heel transition point, and wherein a ratio of (i) a width of the waist to (ii) a width of a widest part of the single continuous sole closest to the back end is less than about 85 percent. In some embodiments, the waist is positioned at between 64 percent and 80 percent the length of the single continuous sole from a toe transition point to a heel transition point and the ratio of (i) a width of the waist to (ii) a width of a widest part of the single continuous sole closest to the back end is between 30 percent and 85 percent. The above different embodiments with respect to the high-waisted ballet pointe shoe, the classic ballet pointe shoe, and the other ballet pointe shoes manufactured by different manufacturers and their corresponding percentages will be discussed in more detail below with respect to the figures and examples.

The pending disclosure also teaches a ballet pointe shoe that comprises a platform having a concave surface. Having at least a portion of the platform comprise a concave surface may allow more stability and balance for the dancer while the dancer is in "en pointe" stance. In some embodiments, the ballet pointe shoe that comprises a platform having a concave surface also comprises a high-waisted, single continuous sole as discussed above.

Turning now to FIG. 1, FIG. 1 illustrates an embodiment of a high-waisted ballet pointe shoe 100 having a toebox 102, a platform 104, a heel 106, a sole 108, a shank 110, and an upper 112. The toebox 102 is located in the front end of the high-waisted ballet pointe shoe 100 and is a hard enclosure that encases and supports a dancer's toes. The front end of the toebox 102 is flattened so as to form the platform 104. The high-waisted ballet pointe shoe 100 compresses the dancer's foot and the platform 104 functions as a contact surface to the floor, on which a dancer balances when in "en pointe" stance. The heel 106 of the high-waisted ballet pointe shoe 100 is located at the back of the high-waisted ballet pointe shoe 100, opposite the platform 104, and does not typically offer any structural support to the dancer. The sole 108 is the bottom part of the high-waisted ballet pointe shoe 100, which in most ballet pointe shoes, is constructed from a single piece of leather attached to the shoe with adhesive reinforced by stitching along its edges. The shank 110 is a piece of rigid material that serves to stiffen the sole 108 to provide support for the arch of a dancer's foot when in "en pointe" stance. Shanks are typically made from leather, plastic, cardstock, or layers of glue-hardened burlap and are generally designed with a sufficient rigidity to support the body weight of a dancer, while still offering enough flexibility for a dancer to move her foot as necessary within the high-waisted ballet pointe shoe 100. The shank 110 is often covered by a thin fabric, which directly contacts the bottom of the dancer's foot. The upper 112, typically made of satin or canvas, covers the exterior of the high-waisted ballet pointe shoe 100, concealing the box and other internal structural elements, lending an aesthetically pleasing look to the shoe, as depicted in FIG. 1.

As illustrated in FIG. 1, in an embodiment, a back portion of the shank 110 extends towards the heel 106 beyond a back end of the sole 108. For example, the back portion of the shank 110 may extend at least 0.5 centimeters towards the heel 106 beyond the back end of the sole 108. In an embodiment, the back portion of the shank 110 extends about 1 centimeter towards the heel 106 beyond the back end of the sole 108. In another embodiment, the back portion of the shank 110 extends between 0.25 centimeters and 1.25 centimeters towards the heel 106 beyond the back end of the sole 108. In yet another embodiment, the back portion of the shank 110 extends between 0.5 centimeters and 1 centimeter towards the heel 106 beyond the back end of the sole 108. Since the waist in the disclosed high-waited ballet pointe shoe 100 is closer to the heel 106, extending the shank 110 towards the heel 106 beyond a back end of the sole 108 may ensure that heel fabric properly forms to the dancer's heel.

While not shown in FIG. 1 since the upper 112 covers the exterior of the high-waisted ballet pointe shoe 100, at least a portion of the platform 104 may comprise a concave surface. The concave surface may be created during the manufacturing of the high-waisted ballet pointe shoe 100 or post manufacture of the high-waisted ballet pointe shoe 100. In an embodiment, the concave surface is created with a plurality of indentations in the platform 104. Having at least a portion of the platform 104 comprise a concave surface may allow more stability and balance for the dancer while the dancer is in "en pointe" stance.

Figure 2:
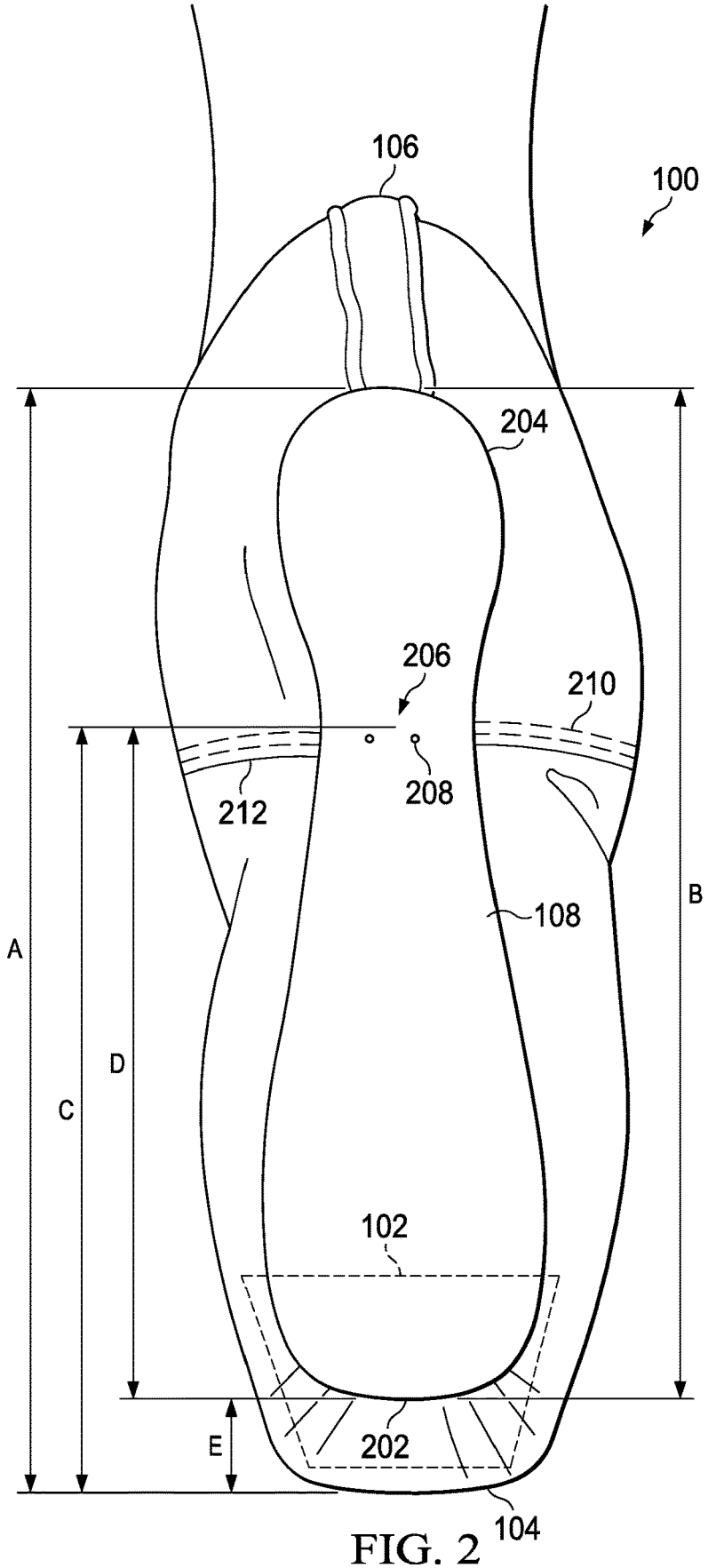
FIG. 2 illustrates a bottom of a ballet pointe shoe according to an embodiment of the disclosure.

Turning to FIG. 2, FIG. 2 illustrates an embodiment of a bottom of the high-waisted ballet pointe shoe 100. The bottom of the high-waisted ballet pointe shoe 100 comprises a front end 202 of the sole 108 closest to the toebox 102, a back end 204 of the sole 108 closest to the heel 106, and a waist 206 defined as the narrowest part of the sole 108. The bottom of the high-waisted ballet pointe shoe 100 may also comprise at least one tack 208 through the shank to the sole 108. In an embodiment, the bottom of the high-waisted ballet pointe shoe 100 comprises two or more tacks through the shank to the sole 108. The at least one tack 208 through the shank to the sole 108 may be positioned at or below the waist 206. In an embodiment, the at least one tack 208 is positioned between the waist 206 and 1 centimeter below the waist 206. In another embodiment, the at least one tack 208 may be positioned between the waist 206 and 0.5 centimeters below the waist 206. Positioning of the at least one tack 208 at or below the waist 206 may add structural support to the high-waisted ballet pointe shoe 100.

The bottom of the ballet pointe shoe 100 may also comprise linear joinders 210, 212. In an embodiment, two or more pieces of fabric are joined with each linear joinder 210, 212. The linear joinders 210, 212 may intersect the sole 108 at the waist 206. In an embodiment, the linear joinders 210, 212 intersect the sole 108 within 0.5 centimeters of the waist 206. In an embodiment, the linear joinders 210, 212 interest the sole 108 within 0.2 centimeters of the waist 206. The linear joinders 210, 212 may comprise stitching two pieces of fabric together.

Also illustrated in FIG. 2 are numerous measurements A-E. Measurement A is the length from the platform 104 to the back end 204 of the sole 108. Measurement B is the length from the front end 202 of the sole 108 to the back end 204 of the sole 108. Measurement C is the length from the platform 104 to the waist 206. Measurement D is the length from the front end 202 of the sole 108 to the waist 206. Measurement E is the length from the platform 104 to the front end 202 of the sole 108. Each of the measurements A-E will be discussed in more detail below with respect to the examples. Measurements A-E are relevant to the first embodiment discussed above and further below looking at the ratio of the waist 206 of the sole 108 from the front end 202 of the sole 108 to the total length of the sole 108 and the second embodiment discussed above and further below looking at the ratio of the waist 206 from the platform 104 to the length of the shoe from the platform 104 to the back end 204 of the sole 108.

Figure 3:
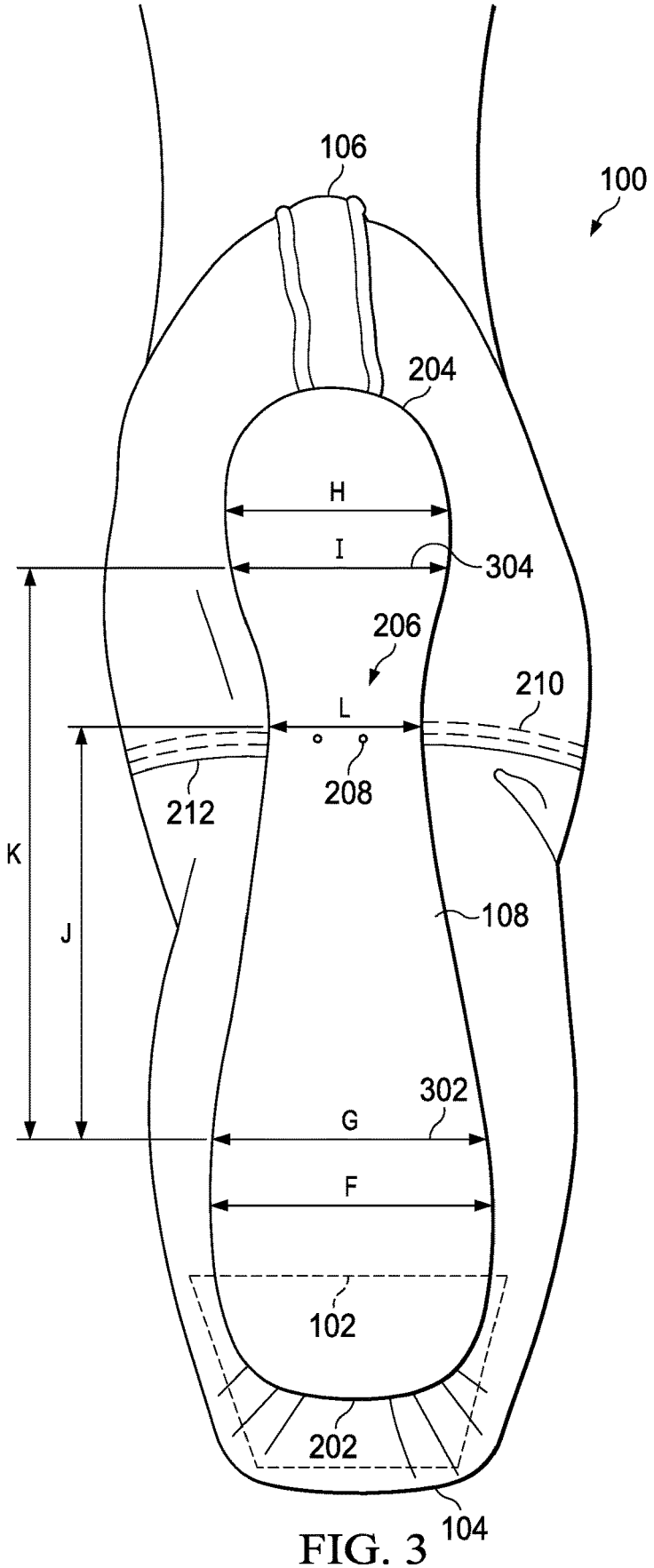
FIG. 3 illustrates a bottom of a ballet pointe shoe according to another embodiment of the disclosure.

Turning to FIG. 3, FIG. 3 illustrates another embodiment of a bottom of the high-waisted ballet pointe shoe 100. The bottom of the high-waisted ballet pointe shoe 100 illustrated in FIG. 3 is substantially similar to the bottom of the high-waisted ballet pointe shoe 100 discussed above in FIG. 2 (for example regarding the toebox 102, the platform 104, the heel 106, the sole 108, the front end 202 of the sole 108, the back end 204 of the sole 108, the waist 206, the at least one tack 208, and the linear joinders 210, 212) except that the bottom of the high-waisted ballet pointe shoe 100 illustrated in FIG. 3 comprises a toe transition point 302 and a heel transition point 304 as well as different measurements F-L.

Measurement F is the width of a widest part of the sole 108 closest to the front end 202 of the sole 108. Measurement G is a point, called herein the toe transition point 302, at which there is a 5 percent change from the widest part of the sole 108 closest to the front end 202 of the sole 108 toward the waist 206. Measurement H is the width of a widest part of the sole 108 closest to the back end 204 of the sole 108. Measurement I is a point, called herein the heel transition point 304, at which there is a 5 percent change from a widest part of the sole 108 closest to the back end 204 of the sole 108 toward the waist 206. Measurement J is the length from the toe transition point 302 to the waist 206. Measurement K is the length from the toe transition point 302 to the heel transition point 304. Measurement L is the width of the waist 206. Each of measurements F-I and L are perpendicular to a center line of the sole 108. Each of the measurements F-L will be discussed in more detail below with respect to the examples. Measurements F-L are relevant to the third embodiment discussed above and further below looking the ratio of the toe transition point 302 to the waist 206 to the toe transition point 302 to a heel transition point 304.

Figure 4:
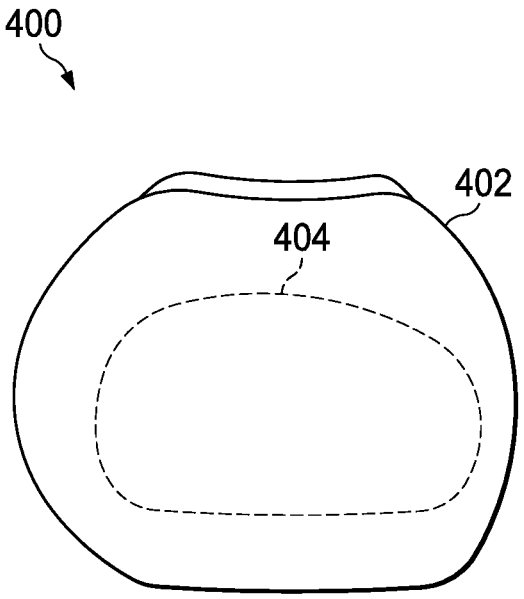
FIG. 4 illustrates a front of ballet pointe shoe according to an embodiment of the disclosure.

Turning to FIG. 4, FIG. 4 illustrates an embodiment of a front of a ballet pointe shoe 400. In particular, FIG. 4 illustrates a platform 402. The front end of a toebox (not illustrated in FIG. 4) is flattened so as to form the platform 402. The platform 402 functions as a contact surface to the floor, on which a dancer balances when in "en pointe" stance. At least a portion of the platform 402 may comprise a concave surface 404. While illustrated as an oval shape in FIG. 4, the concave surface 404 could be a different shape without departing from the spirit or scope of the present disclosure. For example, the concave surface 404 could be a circular shape, a diamond shape, a square shape, a rectangular shape, a heptagonal shape, a hexagonal shape, or another shape. The concave surface 404 may be created during the manufacturing of the ballet pointe shoe 400 or post manufacture of ballet pointe shoe 400. In an embodiment, the concave surface 404 is created with a plurality of indentations in the platform 402. In some embodiments, the ballet pointe shoe 400 that comprises the platform 402 having the concave surface 404 also comprises a high-waisted, single continuous sole as discussed above in FIGS. 1-3. Having at least a portion of the platform 402 comprise the concave surface 404 may allow more stability and balance for the dancer while the dancer is in "en pointe" stance.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

EXAMPLES

The disclosure having been generally described, the following examples are given as particular embodiments of the disclosure and to demonstrate the practice and advantages thereof. It is understood that the examples are given by way of illustration and are not intended to limit the specification or the claims in any manner.

Example 1

Classic Ballet Pointe Shoe

TABLE 1

| | A | B | C | D | E |
|---|---|---|---|---|---|
| U.S. Size 7 | | | | | |
| Classic | 7½ | 6 15/16 | 4½ | 3 15/16 | ½ |
| U.S. Size 10 | | | | | |
| Classic | 8½ | 7¾ | 5⅛ | 4⅜ | ⅝ |
| U.S. Size 4 | | | | | |
| Classic | 6 11/16 | 6 | 4 1/16 | 3⅜ | 9/16 |

Table 1 provides the measurements A-E (in inches) discussed above with respect to FIG. 2 of three different sizes (i.e., U.S. size 7, U.S. size 10, and U.S. size 4) of the classic ballet pointe shoe.

TABLE 2

| | Ratio of Waist from Front End of Sole to Total Length of Sole (D/B) | Ratio of Waist from the Platform to Length of Shoe from Platform to Back End of Sole (C/A) |
|---|---|---|
| U.S. Size 7 | | |
| Classic | 0.5676 | 0.6 |
| U.S. Size 10 | | |
| Classic | 0.5645 | 0.6029 |
| U.S. Size 4 | | |
| Classic | 0.5625 | 0.6075 |

Table 2 provides the ratios of the waist 206 from the front end 202 of the sole 108 (measurement D) to the total length of the sole 108 (measurement B) for the three different sizes of the classic ballet pointe shoe. In particular, the ratio of the waist 206 from the front end 202 of the sole 108 (measurement D) to the total length of the sole 108 (measurement B) is about 56 percent. Table 2 also provides the ratios of the waist 206 from the platform 104 (measurement C) to the length of the shoe from the platform 104 to the back end 204 of the sole 108 (measurement A) for the three different sizes of the classic ballet pointe shoe. Specifically, the ratio of the waist 206 from the platform 104 (measurement C) to the length of the shoe from the platform 104 to the back end 204 of the sole 108 (measurement A) for the classic ballet pointe shoe is about 60 percent.

TABLE 3

| | Waist to End of Sole (B − D) | Ratio of Waist to End of Sole to Waist to Front of Sole ((B − D/D) |
|---|---|---|
| U.S. Size 7 | | |
| Classic | 3 | 0.7819 |
| U.S. Size 10 | | |
| Classic | 3.375 | 0.7714 |
| U.S. Size 4 | | |
| Classic | 2.625 | 0.7778 |

Table 3 provides the length of the waist 206 to the back end 204 of the sole 108 (measurement B minus measurement D) and the ratios of (i) the waist 206 to the back end 204 of the sole 108 to (ii) the waist 206 to the front end 202 of the sole 108 (measurement B minus D divided by measurement D) for the three different sizes of the classic ballet pointe shoes. Specifically, the ratios of (i) the waist 206 to the back end 204 of the sole 108 to (ii) the waist 206 to the front end 202 of the sole 108 (measurement B minus D divided by measurement D) for the three different sizes of the classic ballet pointe shoes are at least 77 percent.

TABLE 4

| | F | G | H | I | J | K | L |
|---|---|---|---|---|---|---|---|
| U.S. Size 7 | | | | | | | |
| Classic | 1.9412 | 1.8441 | 1.4639 | 1.3907 | 1.9731 | 3.6597 | 1.0599 |
| U.S. Size 10 | | | | | | | |
| Classic | 2.1108 | 2.0052 | 1.5752 | 1.4964 | 1.9533 | 3.8435 | 1.1341 |
| U.S. Size 4 | | | | | | | |
| Classic | 1.7383 | 1.6514 | 1.3178 | 1.2519 | 1.5140 | 3.0561 | 0.8972 |

Table 4 provides the measurements F-L (in inches) discussed above with respect to FIG. 3 of three different sizes (i.e., U.S. size 7, U.S. size 10, and U.S. size 4) of the classic ballet pointe shoe.

TABLE 5

| | Ratio of Toe Transition Point to Waist to Toe Transition Point to Heel Transition Point (J/K) |
|---|---|
| U.S. Size 7 | |
| Classic | 0.5391 |
| U.S. Size 10 | |
| Classic | 0.5082 |
| U.S. Size 4 | |
| Classic | 0.4954 |

Table 5 provides the ratio of the toe transition point 302 to the waist 206 (measurement J) to the toe transition point 302 to the heel transition point 304 (measurement K). Specifically, the ratio of the toe transition point 302 to the waist 206 (measurement J) to the toe transition point 302 to the heel transition point 304 (measurement K) ranges from about 49 percent to about 54 percent depending on shoe size.

TABLE 6

| | Ratio of Width of Waist to Width of Widest Part of Sole Closest to Back End (L/H) |
|---|---|
| U.S. Size 7 | |
| Classic | 0.7240 |
| U.S. Size 10 | |
| Classic | 0.7200 |
| U.S. Size 4 | |
| Classic | 0.7659 |

Table 6 provides the ratios of (i) the width of the waist 206 (measurement L) to (ii) the width of the widest part of the sole 108 closest to the back end 204 of the sole 108 (measurement H) for the three different sizes of the classic ballet pointe shoe. Specifically, the ratios of (i) the width of the waist 206 (measurement L) to (ii) the width of the widest part of the sole 108 closest to the back end 204 of the sole 108 (measurement H) for the three different sizes of the classic ballet pointe shoes are less than 77 percent.

Example 2

High-Waisted Ballet Pointe Shoe

TABLE 7

| | A | B | C | D | E |
|---|---|---|---|---|---|
| U.S. Size 7 | | | | | |
| High- Waisted U.S. Size 10 | 7⅝ | 6⅞ | 5⅜ | 4⅝ | ⅝ |
| High- Waisted U.S. Size 4 | 8½ | 7 11/16 | 6⅛ | 5¼ | 11/16 |
| High- Waisted | 6 9/16 | 6 | 4¾ | 4 3/16 | ⅜ |

Table 7 provides the measurements A-E (in inches) discussed above with respect to FIG. 2 of three different sizes (i.e., U.S. size 7, U.S. size 10, and U.S. size 4) of the high-waisted ballet pointe shoe.

TABLE 8

| | Ratio of Waist from Front End of Sole to Total Length of Sole (D/B) | Ratio of Waist from the Platform to Length of Shoe from Platform to Back End of Sole (C/A) |
|---|---|---|
| U.S. Size 7 | | |
| High- Waisted U.S. Size 10 | 0.6727 | 0.7049 |
| High- Waisted U.S. Size 4 | 0.6829 | 0.7206 |
| High- Waisted | 0.6979 | 0.7238 |

Table 8 provides the ratios of the waist 206 from the front end 202 of the sole 108 (measurement D) to the total length of the sole 108 (measurement B) for the three different sizes of the high-waisted ballet pointe shoe. In particular, the ratio of the waist 206 from the front end 202 of the sole 108 (measurement D) to the total length of the sole 108 (measurement B) for the high-waisted ballet pointe shoe ranges from about 67 percent to about 70 percent depending on shoe size. Table 8 also provides the ratios of the waist 206 from the platform 104 (measurement C) to the length of the shoe from the platform 104 to the back end 204 of the sole 108 (measurement A) for the three different sizes of the high-waisted ballet pointe shoe. Specifically, the ratio of the waist 206 from the platform 104 (measurement C) to the length of the shoe from the platform 104 to the back end 204 of the sole 108 (measurement A) for the high-waisted ballet pointe shoe ranges from about 70 percent to about 73 percent depending on shoe size.

TABLE 9

| | Waist to End of Sole (B − D) | Ratio of Waist to End of Sole to Waist to Front of Sole ((B − D)/D) |
|---|---|---|
| U.S. Size 7 | | |
| High- Waisted U.S. Size 10 | 2.25 | 0.4865 |
| High- Waisted U.S. Size 4 | 2.4375 | 0.4643 |
| High- Waisted | 1.8125 | 0.4328 |

Table 9 provides the length of the waist 206 to the back end 204 of the sole 108 (measurement B minus measurement D) and the ratios of (i) the waist 206 to the back end 204 of the sole 108 to (ii) the waist 206 to the front end 202 of the sole 108 (measurement B minus D divided by measurement D) for the three different sizes of the high-waisted ballet pointe shoes. Specifically, the ratio of (i) the waist 206 to the back end 204 of the sole 108 to (ii) the waist 206 to the front end 202 of the sole 108 (measurement B minus D divided by measurement D) for the three different sizes of the high-waisted ballet pointe shoes is at least 43 percent.

TABLE 10

| | F | G | H | I | J | K | L |
|---|---|---|---|---|---|---|---|
| U.S. Size 7 | | | | | | | |
| High- Waisted U.S. Size 10 | 1.9416 | 1.8445 | 1.5278 | 1.4514 | 2.6100 | 3.6285 | 1.0407 |
| High- Waisted U.S. Size 4 | 2.1601 | 2.0521 | 1.6519 | 1.5692 | 3.1131 | 3.9708 | 1.1436 |
| High- Waisted | 1.7383 | 1.6514 | 1.3178 | 1.2519 | 2.2430 | 3.0561 | 1.0093 |

Table 10 provides the measurements F-L (in inches) discussed above with respect to FIG. 3 of three different sizes (i.e., U.S. size 7, U.S. size 10, and U.S. size 4) of the high-waisted ballet pointe shoe.

TABLE 11

| | Ratio of Toe Transition Point to Waist to Toe Transition Point to Heel Transition Point (J/K) |
|---|---|
| U.S. Size 7 | |
| High- Waisted U.S. Size 10 | 0.7193 |
| High- Waisted U.S. Size 4 | 0.7840 |
| High- Waisted | 0.7339 |

Table 11 provides the ratio of the toe transition point 302 to the waist 206 (measurement J) to the toe transition point 302 to the heel transition point 304 (measurement K). Specifically, the ratio of the toe transition point 302 to the waist 206 (measurement J) to the toe transition point 302 to the heel transition point 304 (measurement K) ranges from about 71 percent to about 78 percent depending on shoe size.

TABLE 12

| | Ratio of Width of Waist to Width of Widest Part of Sole Closest to Back End (L/H) |
|---|---|
| U.S. Size 7 | |
| High- Waisted | 0.6812 |
| U.S. Size 10 | |
| High- Waisted | 0.6923 |
| U.S. Size 4 | |
| High- Waisted | 0.6808 |

Table 12 provides the ratios of (i) the width of the waist 206 (measurement L) to (ii) the width of the widest part of the sole 108 closest to the back end 204 of the sole 108 (measurement H) for the three different sizes of the high-waisted ballet pointe shoe. Specifically, the ratios of (i) the width of the waist 206 (measurement L) to (ii) the width of the widest part of the sole 108 closest to the back end 204 of the sole 108 (measurement H) for the three different sizes of the high-waisted ballet pointe shoes are less than about 69 percent.

Example 3

Ballet Pointe Shoes Manufactured by Others

TABLE 13

| U.S. Size 7 | A | B | C | D | E |
|---|---|---|---|---|---|
| Competitor Shoe #1 | 7½ | 6 9/16 | 4⅝ | 3 11/16 | ¾ |
| Competitor Shoe #2 | 7 3/16 | 6 7/16 | 4 13/16 | 4⅛ | ⅝ |
| Competitor Shoe #3 | 6 15/16 | 6 | 4¾ | 3¾ | 15/16 |
| Competitor Shoe #4 | 7 9/16 | 6 9/16 | 4 11/16 | 3¾ | 13/16 |
| Competitor Shoe #5 | 6¾ | 5⅞ | 4¼ | 3⅜ | 11/16 |
| Competitor Shoe #6 | 7½ | 6 11/16 | 4½ | 3¾ | ⅝ |
| Competitor Shoe #7 | 7 13/16 | 6⅞ | 4⅞ | 3⅞ | 13/16 |
| Competitor Shoe #8 | 7¾ | 6¾ | 5 | 4 | ⅞ |
| Competitor Shoe #9 | 7⅛ | 6 3/16 | 3⅞ | 3 | ¾ |

Table 13 provides the measurements A-E (in inches) discussed above with respect to FIG. 2 of nine different manufacturer's U.S. size 7 ballet pointe shoes.

TABLE 14

| U.S. Size 10 | A | B | C | D | E |
|---|---|---|---|---|---|
| Competitor Shoe #1 | 8 9/16 | 7 7/16 | 5⅞ | 4 5/16 | 1 |
| Competitor Shoe #2 | 8½ | 7¾ | 5⅛ | 4⅜ | ⅝ |
| Competitor Shoe #3 | 7 7/16 | 6 5/16 | 5 1/16 | 3 15/16 | 1 |
| Competitor Shoe #4 | 8 5/16 | 7 7/16 | 5 3/16 | 4 5/16 | ¾ |
| Competitor Shoe #5 | 7¾ | 6 13/16 | 4¾ | 3⅞ | 13/16 |
| Competitor Shoe #6 | 8 7/16 | 7½ | 5 5/16 | 4⅜ | 13/16 |
| Competitor Shoe #7 | 7 9/16 | 6 15/16 | 4¾ | 4 3/16 | 7/16 |
| Competitor Shoe #8 | 7½ | 6½ | 4⅞ | 3⅞ | 13/16 |

Table 14 provides the measurements A-E (in inches) discussed above with respect to FIG. 2 of eight different manufacturer's U.S. size 10 ballet pointe shoes.

TABLE 15

| U.S. Size 4 | A | B | C | D | E |
|---|---|---|---|---|---|
| Competitor Shoe #1 | 6 3/16 | 5 9/16 | 3 13/16 | 3 | ⅝ |
| Competitor Shoe #2 | 6 | 5¼ | 3⅞ | 3⅛ | ⅝ |
| Competitor Shoe #3 | 6¼ | 5 5/16 | 4 11/16 | 3¾ | ¾ |
| Competitor Shoe #4 | 6⅝ | 5 13/16 | 3 15/16 | 3 3/16 | ⅝ |
| Competitor Shoe #5 | 6 13/16 | 5¾ | 4 5/16 | 3¼ | ⅞ |

Table 15 provides the measurements A-E (in inches) discussed above with respect to FIG. 2 of five different manufacturer's U.S. size 4 ballet pointe shoes.

TABLE 16

| U.S. Size 7 | Ratio of Waist from Front End of Sole to Total Length of Sole (D/B) | Ratio of Waist from the Platform to Length of Shoe from Platform to Back End of Sole (C/A) |
|---|---|---|
| Competitor Shoe #1 | 0.5619 | 0.6167 |
| Competitor Shoe #2 | 0.6408 | 0.6696 |
| Competitor Shoe #3 | 0.625 | 0.6847 |
| Competitor Shoe #4 | 0.5714 | 0.6198 |
| Competitor Shoe #5 | 0.5745 | 0.6296 |
| Competitor Shoe #6 | 0.5607 | 0.6 |
| Competitor Shoe #7 | 0.5636 | 0.624 |
| Competitor Shoe #8 | 0.5926 | 0.6452 |
| Competitor Shoe #9 | 0.4848 | 0.5439 |

TABLE 17

| U.S. Size 10 | Ratio of Waist from Front End of Sole to Total Length of Sole (D/B) | Ratio of Waist from the Platform to Length of Shoe from Platform to Back End of Sole (C/A) |
|---|---|---|
| Competitor Shoe #1 | 0.5798 | 0.6861 |
| Competitor Shoe #2 | 0.5645 | 0.6029 |
| Competitor Shoe #3 | 0.6238 | 0.6807 |
| Competitor Shoe #4 | 0.5798 | 0.6241 |
| Competitor Shoe #5 | 0.5688 | 0.6129 |
| Competitor Shoe #6 | 0.5833 | 0.6296 |
| Competitor Shoe #7 | 0.6036 | 0.6281 |
| Competitor Shoe #8 | 0.5962 | 0.65 |

TABLE 18

| U.S. Size 4 | Ratio of Waist from Front End of Sole to Total Length of Sole (D/B) | Ratio of Waist from the Platform to Length of Shoe from Platform to Back End of Sole (C/A) |
|---|---|---|
| Competitor Shoe #1 | 0.5393 | 0.6162 |
| Competitor Shoe #2 | 0.5952 | 0.6458 |
| Competitor Shoe #3 | 0.7059 | 0.75 |
| Competitor Shoe #4 | 0.5484 | 0.5943 |
| Competitor Shoe #5 | 0.5652 | 0.6330 |

Tables 16-18 provide the ratios of the waist 206 from the front end 202 of the sole 108 (measurement D) to the total length of the sole 108 (measurement B) for the three different sizes of different manufacturer's ballet pointe shoes. In particular, the ratio of the waist 206 from the front end 202 of the sole 108 (measurement D) to the total length of the sole 108 (measurement B) for the ballet pointe shoes manufactured by the different manufacturers ranges from about 48 percent to about 64 percent depending on shoe size. Tables 16-18 also provide the ratios of the waist 206 from the platform 104 (measurement C) to the length of the shoe from the platform 104 to the back end 204 of the sole 108 (measurement A) for the three different sizes of different manufacturer's ballet pointe shoes. Specifically, the ratio of the waist 206 from the platform 104 (measurement C) to the length of the shoe from the platform 104 to the back end 204 of the sole 108 (measurement A) for the ballet pointe shoes manufactured by the different manufacturers ranges from about 54 percent to about 68 percent depending on shoe size.

One of the ballet pointe shoes manufactured by one of the different manufacturers (i.e., U.S. Size 4 Competitor Shoe #3) has a significantly shorter back end portion of the sole closest to the heel than the high-waisted ballet pointe shoe as illustrated in Table 21 below, which changes the relevance of the ratio of the waist 206 from the platform 104 (measurement C) to the length of the shoe from the platform 104 to the back end 204 of the sole 108 (measurement A) and the relevance of the ratio of the waist 206 from the platform 104 (measurement C) to the length of the shoe from the platform 104 to the back end 204 of the sole 108 (measurement A).

TABLE 19

| U.S. Size 7 | Waist to End of Sole (B − D) | Ratio of Waist to End of Sole to Waist to Front of Sole ((B − D)/D) |
|---|---|---|
| Competitor Shoe #1 | 2.875 | 0.7797 |
| Competitor Shoe #2 | 2.3125 | 0.5606 |
| Competitor Shoe #3 | 2.25 | 0.6 |
| Competitor Shoe #4 | 2.8125 | 0.75 |
| Competitor Shoe #5 | 2.5 | 0.7407 |

TABLE 19-continued

| U.S. Size 7 | Waist to End of Sole (B − D) | Ratio of Waist to End of Sole to Waist to Front of Sole ((B − D)/D) |
|---|---|---|
| Competitor Shoe #6 | 2.9375 | 0.7833 |
| Competitor Shoe #7 | 3 | 0.7742 |
| Competitor Shoe #8 | 2.75 | 0.6875 |
| Competitor Shoe #9 | 3.1875 | 1.0625 |

TABLE 20

| U.S. Size 10 | Waist to End of Sole (B − D) | Ratio of Waist to End of Sole to Waist to Front of Sole ((B − D)/D) |
|---|---|---|
| Competitor Shoe #1 | 3.125 | 0.7246 |
| Competitor Shoe #2 | 3.375 | 0.7714 |
| Competitor Shoe #3 | 2.375 | 0.6032 |
| Competitor Shoe #4 | 3.125 | 0.7246 |
| Competitor Shoe #5 | 2.9375 | 0.7581 |
| Competitor Shoe #6 | 3.125 | 0.7143 |
| Competitor Shoe #7 | 2.75 | 0.6567 |
| Competitor Shoe #8 | 2.625 | 0.6774 |

TABLE 21

| U.S. Size 4 | Waist to End of Sole (B − D) | Ratio of Waist to End of Sole to Waist to Front of Sole ((B − D)/D) |
|---|---|---|
| Competitor Shoe #1 | 2.5625 | 0.8542 |
| Competitor Shoe #2 | 2.125 | 0.68 |
| Competitor Shoe #3 | 1.5625 | 0.4167 |
| Competitor Shoe #4 | 2.625 | 0.8235 |
| Competitor Shoe #5 | 2.5 | 0.7692 |

Tables 19-21 provide the length of the waist 206 to the back end 204 of the sole 108 (measurement B minus measurement D) and the ratios of (i) the waist 206 to the back end 204 of the sole 108 to (ii) the waist 206 to the front end 202 of the sole 108 (measurement B minus D divided by measurement D) for the three different sizes of different manufacturer's ballet pointe shoes. As illustrated in Table 21, for the ballet pointe shoe with the ratio of the waist 206 from the platform 104 (measurement C) to the length of the shoe from the platform 104 to the back end 204 of the sole 108 (measurement A) higher than 65 percent and the ratio of the waist 206 from the platform 104 (measurement C) to the length of the shoe from the platform 104 to the back end 204 of the sole 108 (measurement A) higher than 69 percent (i.e., U.S. Size 4 Competitor Shoe #3), the ratio of (i) the waist 206 to the back end 204 of the sole 108 to (ii) the waist 206 to the front end 202 of the sole 108 (measurement B minus D divided by measurement D) is less than 42 percent.

TABLE 22

| U.S. Size 7 | F | G | H | I | J | K | L |
|---|---|---|---|---|---|---|---|
| Competitor Shoe #1 | 2.125 | 2.0188 | 1.5 | 1.2079 | 1.9375 | 3.5625 | 1.0625 |
| Competitor Shoe #2 | 1.9759 | 1.8771 | 1.3385 | 1.2716 | 1.7847 | 2.2946 | 1.2110 |
| Competitor Shoe #3 | 1.6634 | 1.5802 | 1.1881 | 1.1287 | 1.3663 | 2.1980 | 1.0990 |
| Competitor Shoe #4 | 1.9375 | 1.8406 | 1.4375 | 1.3656 | 1.9375 | 3.4375 | 0.9375 |
| Competitor Shoe #5 | 1.7112 | 1.6256 | 1.4260 | 1.3547 | 1.9393 | 3.1942 | 1.0267 |

TABLE 22-continued

| U.S. Size 7 | F | G | H | I | J | K | L |
|---|---|---|---|---|---|---|---|
| Competitor Shoe #6 | 1.9972 | 1.8973 | 1.8156 | 1.7248 | 1.7854 | 3.4194 | 0.9683 |
| Competitor Shoe #7 | 2.1007 | 1.9957 | 1.5278 | 1.4514 | 2.3553 | 3.7558 | 1.0822 |
| Competitor Shoe #8 | 2.007 | 1.9064 | 1.4595 | 1.3865 | 1.7331 | 3.1926 | 1.0946 |
| Competitor Shoe #9 | 1.9375 | 1.8406 | 1.4375 | 1.3656 | 1.625 | 3.5312 | 0.4375 |

Table 22 provides the measurements F-L (in inches) discussed above with respect to FIG. 3 of nine different manufacturer's U.S. size 7 ballet pointe shoes.

TABLE 23

| U.S. Size 10 | F | G | H | I | J | K | L |
|---|---|---|---|---|---|---|---|
| Competitor Shoe #1 | 2.3737 | 2.2550 | 1.7090 | 1.6236 | 2.2471 | 3.8928 | 1.2027 |
| Competitor Shoe #2 | 2.2478 | 2.1354 | 1.4762 | 1.4024 | 2.0130 | 2.8853 | 1.3084 |
| Competitor Shoe #3 | 1.7953 | 1.7055 | 1.2741 | 1.2014 | 1.7374 | 3.0404 | 1.1003 |
| Competitor Shoe #4 | 2.2453 | 2.1330 | 1.7541 | 1.6664 | 2.1751 | 3.8591 | 1.0525 |
| Competitor Shoe #5 | 2.0293 | 1.9278 | 1.5944 | 1.5147 | 2.0293 | 3.6237 | 1.1016 |
| Competitor Shoe #6 | 2.0424 | 1.9403 | 1.5737 | 1.4950 | 2.0424 | 3.8839 | 1.0379 |
| Competitor Shoe #7 | 1.9905 | 1.8910 | 1.5514 | 1.4739 | 2.0491 | 3.8054 | 1.0245 |
| Competitor Shoe #8 | 2.0787 | 1.9747 | 1.3579 | 1.3165 | 1.7487 | 2.8706 | 1.0558 |

Table 23 provides the measurements F-L (in inches) discussed above with respect to FIG. 3 of eight different manufacturer's U.S. size 10 ballet pointe shoes.

TABLE 24

| U.S. Size 4 | F | G | H | I | J | K | L |
|---|---|---|---|---|---|---|---|
| Competitor Shoe #1 | 1.7293 | 1.6428 | 1.2681 | 1.2047 | 1.4411 | 2.6516 | 0.9222 |
| Competitor Shoe #2 | 1.6875 | 1.6031 | 1.1518 | 1.0942 | 1.3125 | 1.9286 | 1.0714 |
| Competitor Shoe #3 | 1.7418 | 1.6547 | 1.1902 | 1.1307 | 1.4515 | 2.0321 | 1.1031 |
| Competitor Shoe #4 | 1.7690 | 1.6806 | 1.3759 | 1.3071 | 1.5163 | 2.9484 | 0.7862 |
| Competitor Shoe #5 | 1.7424 | 1.6553 | 1.2197 | 1.1587 | 1.9167 | 3.3106 | 0.9874 |

Table 24 provides the measurements F-L (in inches) discussed above with respect to FIG. 3 of five different manufacturer's U.S. size 4 ballet pointe shoes.

TABLE 25

| U.S. Size 7 | Ratio of Toe Transition Point to Waist to Toe Transition Point to Heel Transition Point (J/K) |
|---|---|
| Competitor Shoe #1 | 0.5439 |
| Competitor Shoe #2 | 0.7778 |
| Competitor Shoe #3 | 0.6216 |
| Competitor Shoe #4 | 0.5636 |

TABLE 25-continued

| U.S. Size 7 | Ratio of Toe Transition Point to Waist to Toe Transition Point to Heel Transition Point (J/K) |
|---|---|
| Competitor Shoe #5 | 0.6071 |
| Competitor Shoe #6 | 0.5221 |
| Competitor Shoe #7 | 0.6271 |
| Competitor Shoe #8 | 0.5421 |
| Competitor Shoe #9 | 0.4301 |

TABLE 26

| U.S. Size 10 | Ratio of Toe Transition Point to Waist to Toe Transition Point to Heel Transition Point (J/K) |
|---|---|
| Competitor Shoe #1 | 0.5772 |
| Competitor Shoe #2 | 0.6977 |
| Competitor Shoe #3 | 0.5714 |
| Competitor Shoe #4 | 0.5636 |
| Competitor Shoe #5 | 0.5600 |
| Competitor Shoe #6 | 0.5259 |
| Competitor Shoe #7 | 0.5385 |
| Competitor Shoe #8 | 0.6092 |

TABLE 27

| U.S. Size 4 | Ratio of Toe Transition Point to Waist to Toe Transition Point to Heel Transition Point (J/K) |
|---|---|
| Competitor Shoe #1 | 0.5435 |
| Competitor Shoe #2 | 0.6805 |
| Competitor Shoe #3 | 0.7143 |
| Competitor Shoe #4 | 0.5143 |
| Competitor Shoe #5 | 0.5790 |

Tables 25-27 provide the ratios of the toe transition point 302 to the waist 206 (measurement J) to the toe transition point 302 to the heel transition point 304 (measurement K) for the three different sizes of different manufacturer's ballet pointe shoes. In particular, the ratio of the toe transition point 302 to the waist 206 (measurement J) to the toe transition point 302 to the heel transition point 304 (measurement K) for the ballet pointe shoes manufactured by the different manufacturers ranges from about 43 percent to about 63 percent depending on shoe size.

Some of the ballet pointe shoes manufactured by one or more of the different manufacturers (i.e., U.S. Size 7 Competitor Shoe #2, U.S. Size 10 Competitor Shoe #2, U.S. Size 4 Competitor Shoe #2, U.S. Size 4 Competitor Shoe #3) have a significantly narrower, more uniform back end portion of the sole closest to the heel than the high-waisted ballet pointe shoe as illustrated in Tables 28-30 below, which changes the relevance of the ratio of the toe transition point 302 to the waist 206 to the toe transition point 302 to the heel transition 304.

TABLE 28

| U.S. Size 7 | Ratio of Width of Waist to Width of Widest Part of Sole Closest to Back End (L/H) |
|---|---|
| Competitor Shoe #1 | 0.7083 |
| Competitor Shoe #2 | 0.9047 |
| Competitor Shoe #3 | 0.9250 |
| Competitor Shoe #4 | 0.6522 |
| Competitor Shoe #5 | 0.7200 |
| Competitor Shoe #6 | 0.5333 |
| Competitor Shoe #7 | 0.7083 |
| Competitor Shoe #8 | 0.7500 |
| Competitor Shoe #9 | 0.3043 |

TABLE 29

| U.S. Size 10 | Ratio of Width of Waist to Width of Widest Part of Sole Closest to Back End (L/H) |
|---|---|
| Competitor Shoe #1 | 0.7037 |
| Competitor Shoe #2 | 0.8863 |

TABLE 29-continued

| U.S. Size 10 | Ratio of Width of Waist to Width of Widest Part of Sole Closest to Back End (L/H) |
|---|---|
| Competitor Shoe #3 | 0.8636 |
| Competitor Shoe #4 | 0.6000 |
| Competitor Shoe #5 | 0.6909 |
| Competitor Shoe #6 | 0.6595 |
| Competitor Shoe #7 | 0.6604 |
| Competitor Shoe #8 | 0.7775 |

TABLE 30

| U.S. Size 4 | Ratio of Width of Waist to Width of Widest Part of Sole Closest to Back End (L/H) |
|---|---|
| Competitor Shoe #1 | 0.7272 |
| Competitor Shoe #2 | 0.9325 |
| Competitor Shoe #3 | 0.9268 |
| Competitor Shoe #4 | 0.5714 |
| Competitor Shoe #5 | 0.8095 |

Tables 28-30 provide the ratios of (i) the width of the waist 206 (measurement L) to (ii) the width of the widest part of the sole 108 closest to the back end 204 of the sole 108 (measurement H) for the three different sizes of different manufacturer's ballet pointe shoes. As illustrated in Table 28-30, for the ballet pointe shoes with the ratio of the toe transition point 302 to the waist 206 to the toe transition point 302 to the heel transition 304 higher than 63 percent (i.e., U.S. Size 7 Competitor Shoe #2, U.S. Size 10 Competitor Shoe #2, U.S. Size 4 Competitor Shoe #2, U.S. Size 4 Competitor Shoe #3), the ratio of (i) the width of the waist 206 (measurement L) to (ii) the width of the widest part of the sole 108 closest to the back end 204 of the sole 108 (measurement H) is greater than 88 percent.

What is claimed is:

1. A ballet pointe shoe, comprising:

a toebox;

a platform at a front end of the toebox;

a shank;

an upper;

a heel; and a single continuous sole comprising:

a front end closest to the toebox, a back end closest to the heel, and a waist defined as a narrowest part of the single continuous sole, wherein the waist is positioned on the single continuous sole at more than 65 percent of a length of the single continuous sole from the front end of the single continuous sole to the back end of the single continuous sole such that a ratio of (i) a distance from the waist to the front end of the single continuous sole to (ii) a distance from the front end of the single continuous sole to the back end of the single continuous sole is more than 65 percent, and wherein a ratio of (i) a distance from the waist to the back end of the single continuous sole to (ii) a distance from the waist to the front end of the single continuous sole is at least 42 percent.

2. The ballet pointe shoe of claim 1, wherein the waist is positioned at more than 66 percent of the length of the single continuous sole from the front end of the single continuous sole.

3. The ballet pointe shoe of claim 2, wherein the waist is positioned at more than 67 percent of the length of the single continuous sole from the front end of the single continuous sole.

4. The ballet pointe shoe of claim 1, wherein two pieces of fabric are joined with a linear joinder that intersects the single continuous sole at the waist.

5. The ballet pointe shoe of claim 1, further comprising at least one tack through the shank to the single continuous sole, wherein the at least one tack is positioned at or below the waist.

6. The ballet pointe shoe of claim 5, wherein the at least one tack is positioned between the waist and 0.5 centimeters below the waist.

7. The ballet pointe shoe of claim 1, wherein a back portion of the shank extends more than 0.5 centimeters towards the heel beyond the back end of the single continuous sole.

8. The ballet pointe shoe of claim 7, wherein the back portion of the shank extends at least 1 centimeter towards the heel beyond the back end of the single continuous sole.

9. A ballet pointe shoe, comprising:
a toebox;
a platform at a front end of the toebox;
a shank;
an upper;
a heel; and
a single continuous sole comprising:
a front end closest to the toebox,
a back end closest to the heel, and
a waist defined as a narrowest part of the single continuous sole, wherein the waist is positioned on the single continuous sole at more than 69 percent of a length of the ballet pointe shoe from the platform to the back end of the single continuous sole such that a ratio of (i) a distance from the waist to the platform to (ii) a distance from the platform to the back end of the single continuous sole is more than 69 percent, and wherein a ratio of (i) a distance from the waist to the back end of the single continuous sole to (ii) a distance from the waist to the front end of the single continuous sole is at least 42 percent.

10. The ballet pointe shoe of claim 9, wherein the waist is positioned at more than 70 percent of the ballet pointe shoe from the platform to the back end of the single continuous sole.

11. The ballet pointe shoe of claim 9, wherein the ratio of (i) the waist to the back end of the single continuous heel to (ii) the waist to the front end of the single continuous heel is at least 43 percent.

12. The ballet pointe shoe of claim 9, wherein two pieces of fabric are joined on a first side of the ballet pointe shoe with a first linear joinder that intersects the single continuous sole within 0.2 centimeters of the waist, and wherein two pieces of fabric are joined on a second side of the ballet pointe shoe with a second linear joinder that intersects the single continuous sole within 0.2 centimeters of the waist.

13. The ballet pointe shoe of claim 9, wherein at least a portion of an outer surface of the platform comprises a concave surface.

14. The ballet pointe shoe of claim 9, wherein a back portion of the shank extends between 0.5 centimeters and 1 centimeter towards the heel beyond the back end of the single continuous sole.

15. A ballet pointe shoe, comprising:
a toebox;
a platform at a front end of the toebox;
a shank;
an upper;
a heel; and
a single continuous sole comprising:
a front end closest to the toebox,
a back end closest to the heel, and
a waist defined as a narrowest part of the single continuous sole, wherein the waist is positioned at more than 64 percent of a length of the single continuous sole from a toe transition point to a heel transition point such that a ratio of (i) a distance from the waist to the toe transition point to (ii) a distance from the toe transition point to the heel transition point is more than 64 percent, wherein the toe transition point is a point on the single continuous sole at which there is a 5 percent change from a widest part of the single continuous sole closest to the front end toward the waist, wherein the heel transition point is a point on the single continuous sole at which there is a 5 percent change from a widest part of the single continuous sole to the back end toward the waist, and wherein a ratio of (i) a width of the waist to (ii) a width of a widest part of the single continuous sole closest to the back end is less than 85 percent.

16. The ballet pointe shoe of claim 15, wherein the waist is positioned at more than at least 70 percent of the length of the single continuous sole from the toe transition point to the heel transition point.

17. The ballet pointe shoe of claim 16, wherein the waist is positioned at more than at least 71 percent of the length of the single continuous sole from the toe transition point to the heel transition point.

18. The ballet pointe shoe of claim 15, further comprising at least one tack through the shank to the single continuous sole, wherein the at least one tack is positioned between the waist and 0.5 centimeters below the waist.

19. The ballet pointe shoe of claim 15, wherein two pieces of fabric are joined with a linear joinder that intersects the single continuous sole at the waist.

20. The ballet pointe shoe of claim 19, wherein the linear joinder comprises stitching the two pieces of fabric together.

21. A ballet pointe shoe, comprising:
a toebox;
a shank;
an upper;
a heel; and
a platform at a front end of the toebox, wherein at least a portion of an outer surface of the platform including a center point of the platform comprises a concave surface, and wherein the concave surface comprises a plurality of indentations.

* * * * *